United States Patent [19]

Okoma et al.

[11] Patent Number: 4,815,947

[45] Date of Patent: Mar. 28, 1989

[54] COMPRESSOR AND METHOD OF ASSEMBLING THEREOF

[75] Inventors: Kaoru Okoma, Fujinomiya; Eiichiro Fujii; Morio Hanada, both of Fuji, all of Japan

[73] Assignee: Kabushiki Kaisha Toshiba, Kawasaki, Japan

[21] Appl. No.: 930,105

[22] Filed: Nov. 13, 1986

[30] Foreign Application Priority Data

Nov. 15, 1985 [JP] Japan ..... 60-256090

[51] Int. Cl.[4] ..... F04B 39/12

[52] U.S. Cl. ..... 417/410; 417/902; 228/165; 228/184; 228/265.14; 219/118

[58] Field of Search ..... 417/902, 410; 228/208, 228/209, 165, 168, 173.4, 189, 184, 263.14; 219/118, 85 M

[56] References Cited

U.S. PATENT DOCUMENTS

| | | | |
|---|---|---|---|
| 776,737 | 12/1904 | Greenfield | 228/165 |
| 1,485,645 | 3/1924 | Tindale | 228/165 X |
| 1,804,837 | 5/1931 | Lunn | 228/165 X |
| 2,137,097 | 11/1938 | Sateren | 228/208 X |
| 2,685,125 | 8/1954 | Hansen et al. | 228/208 X |
| 3,125,805 | 3/1964 | Horigan | 228/208 X |
| 3,584,187 | 6/1971 | Majetich | 219/118 X |
| 3,675,310 | 7/1972 | Schwaneke et al. | 228/208 X |
| 3,957,289 | 5/1976 | Kilgore et al. | 228/165 X |
| 4,306,139 | 12/1981 | Shinozaki et al. | 219/118 X |
| 4,628,178 | 12/1986 | Miyake et al. | 219/118 X |
| 4,648,811 | 3/1987 | Tanata et al. | 417/902 X |

FOREIGN PATENT DOCUMENTS

| | | | |
|---|---|---|---|
| 426775 | 11/1947 | Italy | 228/165 |
| 56-36372 | 4/1981 | Japan | 228/165 |
| 57-176388 | 10/1982 | Japan . | |
| 58-93583 | 6/1983 | Japan | 228/210 |

*Primary Examiner*—Carlton R. Croyle
*Assistant Examiner*—Eugene L. Szczecina, Jr.
*Attorney, Agent, or Firm*—Oblon, Fisher, Spivak, McCelland & Maier

[57] ABSTRACT

A compressor comprises a casing having an aperture, a compressor unit provided in the casing, and an electric motor for driving the compressor unit, the electric motor being provided in the casing together with the compressor unit. An iron joint is mounted to the aperture of the casing and is formed with an electrically conductive metal coating having a corrosion resistance greater than that of iron on the surface thereof. The iron joint is comprised of a cylindrical portion and a conical outer surface portion welded to the edge of the aperture by resistance welding. A pipe for sucking or discharging gas to or from the casing is brazed into the cylindrical portion of the iron joint with a copper brazing material. Further, a compressor assembling method comprises the steps of forming an electrically conductive metal coating with a corrosion resistance greater than that of iron on the surface of an iron joint, brazing a pipe to the iron joint with a copper brazing material, and welding the iron joint to an aperture formed in the wall of a compressor casing by resistance welding.

11 Claims, 2 Drawing Sheets

COMPRESSOR AND METHOD OF ASSEMBLING THEREOF

BACKGROUND OF THE INVENTION

1. Field of the Invention

The present invention relates generally to a compressor for use in cooling, refrigeration or air-conditioning, and more particularly to a compressor which has an improved structure for coupling a pipe to a casing of the compressor. Further, the present invention relates to a method of assembling of the compressor which has an improved technique for coupling a pipe to a casing of the compressor.

2. Description of the Related Art

A compressor is constructed such that a compressor unit and an electric motor are housed in a hermetic casing. The compressor is equipped with pipes for respectively sucking or discharging refrigerants or coolants to or from other devices, e.g., evaporaters.

In a conventional compressor, there are various ways of coupling a discharging pipe or suction pipe, etc. to a compressor casing. For example, an aperture is formed in a side wall of a compressor casing and an iron joint to which a pipe may be fixed by brazing is fixed in the aperture by welding. If copper is used as the brazing material, there is a problem of embrittlement of the iron joint because of the effects of phosphorus contained in the brazing material and so silver brazing material is typically used. However, silver brazing material is costly, in addition to which automation is difficult since flux is needed during brazing and the flux has to be removed in a subsequent stage. Also, there is a lack of reliability with resistance welding, as the iron joints are liable to rust during storage.

Resistance welding or ring projection welding is practiced by flowing an electric current to a resistive contact portion between members to be welded together. The current flowing in the resistive contact portion generates a large quantity of heat which melts the contact portion. A heat quantity Q in resistance welding is given by a following equation:

$$Q=0.24 \cdot I^2 \cdot R \cdot t$$

where I is a current, R is a resistance at the contact portion including internal resistances of both members to be welded together and t is a time the current flows.

The above described resistance welding is practiced for the contact portion between the casing and the iron joint by pressing electrodes of a resistance welding machine against the casing and the pipe.

SUMMARY OF THE INVENTION

It is an object of the present invention to provide a compressor in which an iron joint is used for coupling a pipe to a compressor casing without occurence of rust of the iron joint.

It is another object of the present invention to provide a compressor assembling method which improves the characteristics of coupling to iron joints even if low-cost copper brazing material ia used and makes it possible to achieve reliable resistance welding.

According to one aspect of the present invention, the compressor comprises a casing having at least one aperture, a compressor unit provided in the casing, an electric motor for driving the compressor unit, the electric motor being provided in the casing together with the compressor unit, an iron joint mounted to each aperture of the casing and having an electrically conductive metal coating with a corrosion resistance greater than that of iron on the surface thereof. The iron joint is comprised of a cylindrical portion and a conical outer surface portion welded to the edge of the aperture by resistance welding. A pipe for sucking or discharging gas to or from the casing is brazed into the cylindrical portion of the iron joint with a copper brazing material.

Further, according to one aspect of the present invention, the compressor assembling method comprises the steps of forming an electrically conductive metal coating with a corrosion resistance greater than that of iron on the surface of an iron joint, brazing a pipe to the iron joint with a copper brazing material, and welding the iron joint to an aperture formed in the wall of a compressor casing by resistance welding.

DESCRIPTION OF THE PREFERRED EMBODIMENTS

The present invention will now be described in detail with reference to the accompanying FIGS. 1 to 5.

Figure 1:
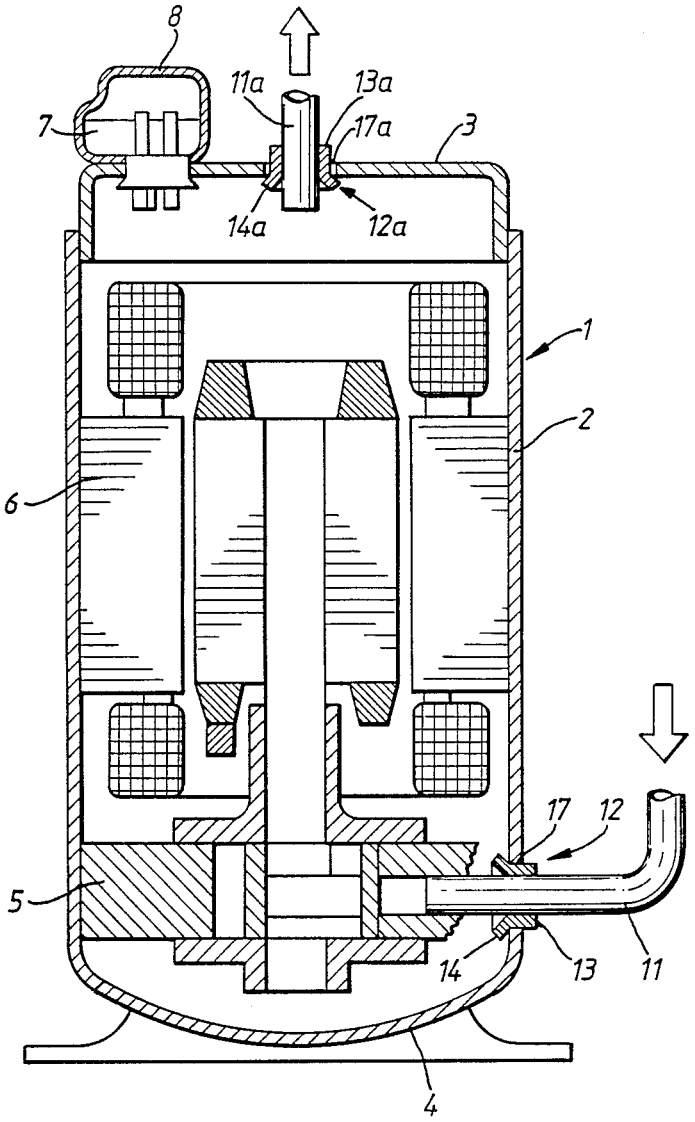
FIG. 1 is a cross section showing an embodiment of a compressor according to the present invention.

Referring now to FIG. 1, there is shown an embodiment of a compressor according to the present invention. In the drawing, a casing 1 is comprised of a cylindrical side wall 2 made of steel, a flat top end wall 3 made also of steel and attached hermetically to the top end of the cylindrical side wall 2 for closing the top end thereof and a spherical bottom end wall 4 formed in one piece with the cylindrical side wall 2 for closing the bottom end of the cylindrical side wall 2. The casing 1 houses hermetically a compressor unit 5 and an electric motor 6 for driving the compressor unit 5. The top end wall 3 of the casing 1 mounts hermetically a terminal block 7 for supplying electric power to the electric motor 6. The portion of the terminal block 7 outside the casing 1 is covered by a terminal box 8.

An aperture 17 is formed in the cylindrical side wall 2 of the casing 1. The aperture 17 receives a pipe made of copper, e.g., a coolant suction pipe 11 made of copper via an iron joint 12 (also shown in FIG. 2). Further, the flat top end wall 3 contains an aperture 17*a*. The aperture 17*a* receives another pipe made of copper, e.g., a coolant discharging pipe 11*a* via another iron joint 12*a*. The iron joints 12 and 12*a* are respectively applied to the edges of the apertures 17 and 17*a* on the inside of the casing 1 and then welded to the cylindrical side wall 2 and the flat top end wall 3 by the resistance welding method as aforementioned. The coolant suction pipe 11 and the coolant discharging pipe 11*a* are respectively fit into the iron joints 12 and 12*a* and then gas-welded thereto with copper brazing material.

Figure 3:
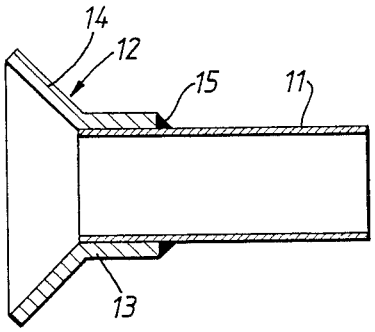
FIG. 3 is a cross section showing brazing of an iron joint and a pipe of one embodiment of the present invention.

In FIG. 3, the iron joint 12 is shaped into funnel-like shape comprised of cylindrical portion 13 and tapered or conically flared portion 14 extending from one end of the cylindrical portion 13. An electrically conductive metal coating with a corrosion resistance greater than that of iron, e.g., a nickel plating, is formed on the outer and inner surfaces of the iron joint 12. The coolant suction pipe 11 is fit into the cylindrical portion 13 of the iron joint 12, and then the coolant suction pipe 11 is gas-welded to the cylindrical portion 13 with copper brazing material 15. Further, the outer conically flared surface of the flare portion 14 is welded to the edge of the aperture 17 formed in the cylindrical side wall 2 by the resistance welding method, as aforementioned.

Figure 2:
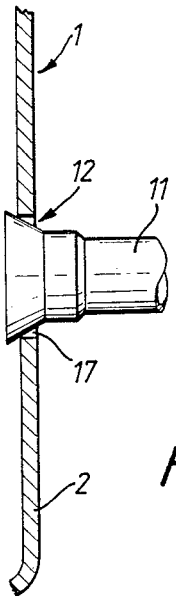
FIG. 2 is a cross section showing a pipe coupling to a compressor casing.

Thus, after the nickel plating on the iron joint 12, the coolant suction pipe 11 is gas-welded to the iron joint 12 with the copper brazing material 15. Then, the outer conically flared surface of the flare portion 14 is welded to the edge of the aperture 17 formed in the cylindrical side wall 2 by the resistance welding method. As a result, the coolant suction pipe 11 is coupled with the cylindrical side wall 2, as shown in FIG. 2. When this is done, even though copper brazing material 15 is used, phosphorus contained in the copper brazing material 16 does not diffuse into the iron joint 12 during brazing, since the iron joint 12 has been nickel plated, and hence there is no fear of brittleness.

Figure 4:
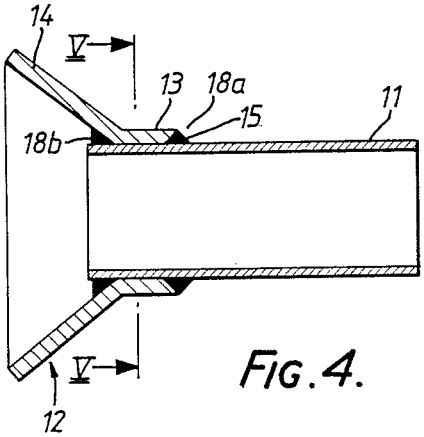
FIG. 4 is a cross section showing brazing of an iron joint and a shape of the another embodiment of the present invention.
Figure 5:
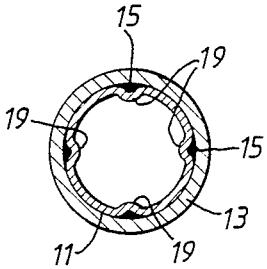
FIG. 5 is a section taking along the line V—V of FIG. 4.

FIGS. 4 and 5 show the second embodiment of the present invention. Axially extending linear grooves or recess portions 19 are formed in the outer peripheral surface of the coolant suction pipe 11. One end of the cylindrical portion 13 of the iron joint 12 is concavely bevelled so as to taper inwardly. The coolant suction pipe 11 is then inserted in the cylindrical portion 13 so as to project one end thereof into the flared portion 14. As a result, the wedge-shaped gap **18*a* is defined at the bevelled portion at the one end of the cylindrical portion 13 and the wedge-shaped gap 18*b* is defined at the outer peripheral surface of the one end of the coolant suction pipe 11**.

Copper brazing material 15 is then set in gap **18*a*, and the coolant suction pipe 11 with the iron joint 12 and the copper brazing material 15 are put in a brazing furnace (not shown). As a result, the brazing material melts and melted copper brazing material 15 runs along the recess portions 19 between the iron joint 12 and the coolant suction pipe 11 for the full length of the cylindrical portion 13. Ultimately, swelling-out of the brazing material, as shown in FIG. 4, occurs in the gap 18*b***, due to surface tension.

The coolant suction pipe 11 with the iron joint 12 are then removed from the brazing furnace and the copper brazing material 15 is cooled and solidified. At this time, there is no occurence of the copper brazing material 15 flowing out to the resistance welded surface of the iron joint 12. After brazing, since the copper brazing material 15 is located at the wedge-shaped gaps **18*a* and 18*b* defined at both ends of the cylindrical portion 13, via the recess portions 19**, the brazing strength is much improved along the pipe axis.

The same result is also obtained if chromium is used instead of nickel as an electrically conductive metal coating with a corrosion resistance greater than that of iron.

Further, in the above embodiment, the invention is applied to the coolant suction pipe 11. However, the present invention is not so limited, and can be applied to the coolant discharging pipe **11*a***.

Furthermore, it is to be understood that the invention is not restricted to the embodiments described above and shown, and that various modifications and changes may be made therein without departing from the spirit and scope of the present invention.

As described above, by effecting an electrically conductive metal coating with corrosion resistance greater than that of iron on the surfaces of the iron joint, the present invention makes it permissible to use low-cost copper brazing material but at the same time increases the strength of brazed portions. There is the further advantage that rusting of the iron joint can be prevented and stability of resistance welding is improved.

Obviously, numerous modifications and variations of the present invention are possible in light of the above teachings. It is therefore to be understood that within the scope of the present claims, the invention may be practiced otherwise than as specifically described herein.

What is claimed as new and desired to be secured by Letters Patent of the United States is:

1. A compressor comprising:

a casing having at least one aperture;

a compressor means provided in said casing;

an electric motor for driving said compressor means, said electric motor being provided in said casing together with said compressor means;

an iron joint mounted to each said aperture of said casing, each said iron joint having an electrically conductive metal coating with a corrosion resistance greater than that of iron on an exterior surface thereof, wherein said iron joint is comprised of a cylindrical portion and a conical outer surface portion, said cylindrical portion having a concavely bevelled portion at an end thereof to define a wedge-shaped gap, one of said cylindrical portion and conical outer surface portion being welded to an edge of said aperture by resistance welding; an a gas pipe including axially extending recesses in the outer peripheral surface thereof, said gas pipe being brazed into said cylindrical portion of said iron joint with a copper brazing material so that said brazing material is elongated from said recesses facing said cylindrical portion of said iron joint to said wedge-shaped gap.

2. A compressor according to claim 1, wherein said conical portion extends from one end of said cylindrical portion, wherein said conical portion is welded to said edge of said aperture by resistance welding.

3. A compressor according to claim 2, wherein an edge of said cylindrical portion of said iron joint is concavely bevelled to define a first wedge-shaped gap, and said pipe is positioned in said cylindrical portion so as to project one end thereof into said conical portion to define a second wedge-shaped gap, said copper brazing material being positioned in both said wedge-shaped gaps.

4. A compressor according to claim 1, wherein said electrically conductive metal coating is a nickel plating.

5. A compressor according to claim 1, wherein said electrically conductive metal coating is a chromium plating.

6. A compressor according to claim 1, wherein said recesses extend over a portion of a length of said pipe corresponding to a major portion of a length of said cylindrical portion.

7. A compressor according to claim 6, wherein said major portion is the full length of said cylindrical portion.

8. A compressor assembling method, comprising the steps of:

forming an electrically conductive metal coating with a corrosion resistance greater than that of iron on the surface of an iron joint, said iron joint including a cylindrical portion having a concavely bevelled portion at an end thereof to define a wedge-shaped gap;

brazing a pipe having axially extending recesses in the outer periphery surface thereof to said iron joint with a copper brazing material located in said recesses and wedge-shaped gap; and welding said iron joint to at least one aperture formed in the wall of a compressor casing by resistance welding.

9. A compressor assembling method according to claim 8, wherein said electrically conductive metal coating is a nickel plating.

10. A compressor assembling method according to claim 8, wherein said electrically conductive metal coating is a chromium plating.

11. A compressor comprising:

a casing having at least one aperture;

a compressor means provided in said casing;

an electric motor for driving said compressor means, said electric motor being provided in said casing together with said compressor means;

an iron joint mounted to each said aperture of said casing, each said iron joint having an electrically conductive metal coating with a corrosion resistance greater than that of iron on an exterior surface thereof, wherein said iron joint is comprised of a cylindrical portion and a conical outer surface portion, said cylindrical portion having a concavely bevelled portion at one end thereof to define a first wedge-shaped gap, one of said cylindrical portion and conical outer surface portion being welded to an edge of said aperture by resistance welding; and a gas pipe including axially extending recesses in the outer peripheral surface thereof, said gas pipe being positioned in said cylindrical portion so as to project one end thereof into said conical portion to define a second wedge-shaped gap, said gas pipe being brazed into said cylindrical portion of said iron joint with a copper brazing material so that said brazing material is elongated from said first wedge-shaped gap to said second wedge-shaped gap through said recesses facing said cylindrical portion of said iron joint.

* * * * *